United States Patent [19]

Vezzani

[11] Patent Number: 4,470,580

[45] Date of Patent: Sep. 11, 1984

[54] METHOD AND APPARATUS FOR PREPARING SCRAP METAL CHARGES FOR SMELTING FURNACES

[75] Inventor: Luciano Vezzani, Ovada, Italy

[73] Assignee: Officine Vezzani S.p.A., Milan, Italy

[21] Appl. No.: 498,706

[22] Filed: May 27, 1983

[51] Int. Cl.[3] ..... C21D 11/00

[52] U.S. Cl. ..... 266/90; 75/44 S; 75/92

[58] Field of Search ..... 75/92, 44 S; 266/901

[56] References Cited

U.S. PATENT DOCUMENTS 2,382,534 8/1945 Baily ..... 75/44 S 3,665,848 5/1972 Kimura ..... 75/44 S

*Primary Examiner*—Peter D. Rosenberg

*Attorney, Agent, or Firm*—Guido Modiano; Albert Josif

[57] ABSTRACT

A method for preparing scrap metal charges to be loaded into a smelting furnace comprises filling a loading container in stages with loose scrap metal and carrying the container on a carriage into a press for compressing the scrap metal directly in the container to a preset density. The compressed scrap metal is charged into the furnace directly from the container. An apparatus for this method comprises a gate press having rails for the carriage and a press die suitable for compressing the scrap metal as arranged in the container. The carriage can be adapted to receive containers of different diameter and the press die can be fitted with a detachable ring to increase the die area for compression.

6 Claims, 6 Drawing Figures

1
2
3
4
5
5
6
7
8
8
9
10
10
11
14
14
II

METHOD AND APPARATUS FOR PREPARING SCRAP METAL CHARGES FOR SMELTING FURNACES

BACKGROUND OF THE INVENTION

This invention relates to a method and an apparatus for preparing scrap metal charges for smelting furnaces.

As is known, in loading scrap metal into smelting furnaces it is common practice to either load the material loose, as piled up at the storing yards, or to first press the scrap metal into blocks and then load the blocks into the furnace.

While either methods have evident advantages of their own, especially in the instance of offcuts of a particular shape, if the optimum density of the charge in a furnace is considered, it must be recognized that neither of the cited prior methods is fully satisfactory, because the blocks, or "briquettes", tend to have too high a density, whilst the loose material has an excessively low density. In fact, the briquette density is not determined by the charge optimum, but rather by the requirement that the briquettes be in a stable state for handling, and if the pressing operations are carried out at a remote site from the furnace, then greater interest is attached to minimizing the specific volume.

There exists a chain of circumstances why the scrap metal is delivered loose to the steel works or smelting plants. It would be desirable here to press the metal scraps to a density more suitable to meet the furnace requirements. However, this would involve, as mentioned above, problems of material handling. It should be further noted that commercially available presses are designed to achieve the highest possible degree of compaction rather than adjustable densities.

Another drawback of the briquette forming method is that it is highly expensive. An accurate analysis of costs reveals that they are highly affected by the need for transporting the material from a loose state storing yard to a briquette storing area. This because the press output product does not yield a unit charge and must be cumulated, thus increasing the space and transport facility requirements.

SUMMARY OF THE INVENTION

It is a primary object of this invention to provide a method and an apparatus for preparing scrap metal to be loaded into smelting furnaces, which can substantially obviate the problems encountered conventionally in the past.

This object has been achieved, according to the invention, by a method of preparing scrap metal charges for smelting furnaces, characterized in that it comprises the steps of: filling a loading container in stages with loose scrap metal; each time pressing the scrap metal in said container to a preset controlled density under a press; and feeding into the smelting furnace the resulting pressed charge directly from said loading container.

According to another aspect of this invention, there is provided an apparatus for preparing scrap metal charges for smelting furnaces, characterized in that it comprises: a loading container; a carriage for supporting and moving said container; and a press, so dimensioned as to press loosely loaded scrap metal directly in said container as placed on said carriage.

BRIEF DESCRIPTION OF THE DRAWINGS

The features and advantages of this invention will be explained in detail by describing some preferred embodiments thereof with reference to the drawings. In the schematical drawings.

DESCRIPTION OF THE PREFERRED EMBODIMENTS

Figure 1:
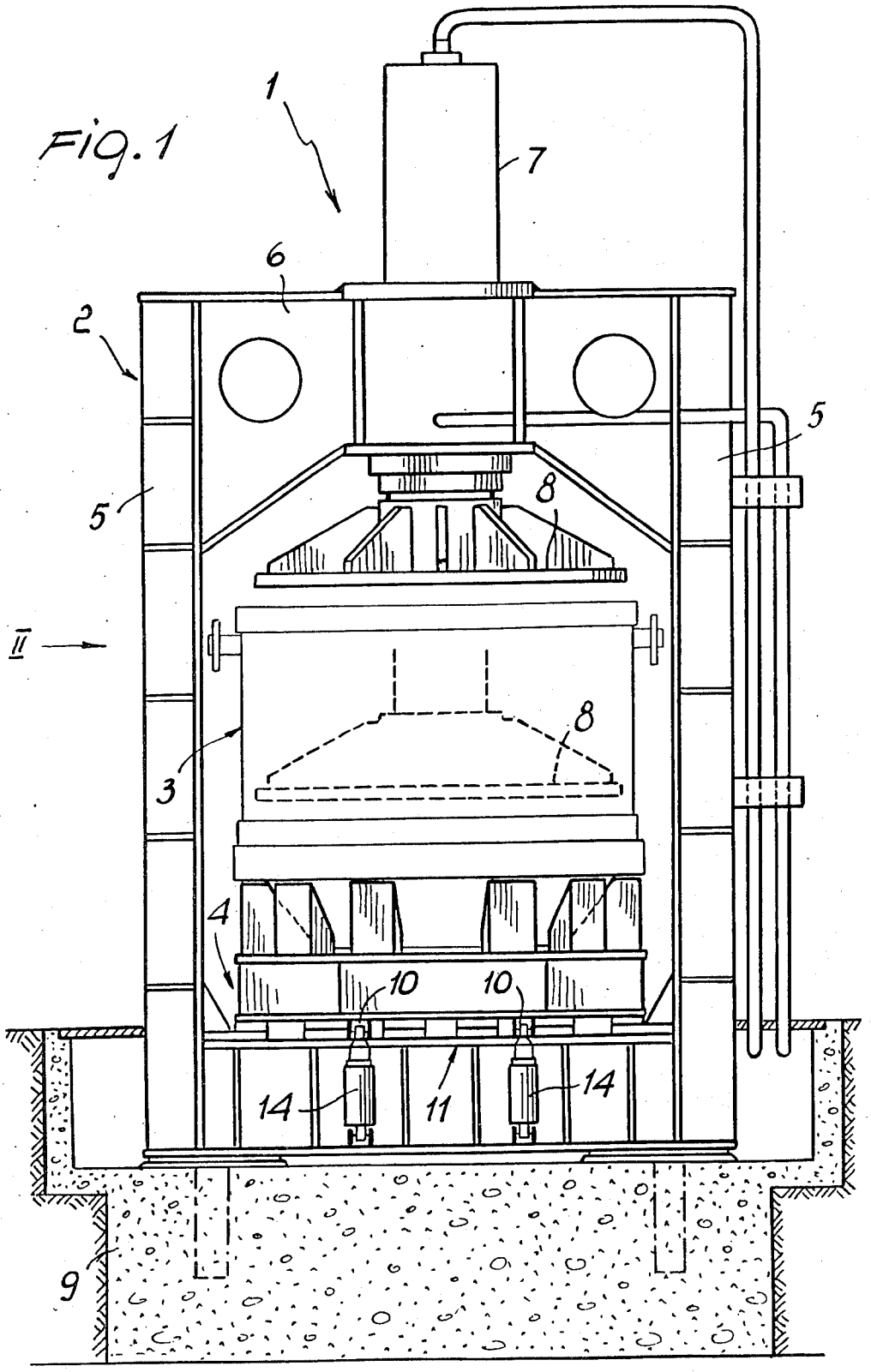
FIG. 1 shows a press according to the invention, as viewed in front elevation, with a scrap metal loading container being subjected to a pressing action.
Figure 2:
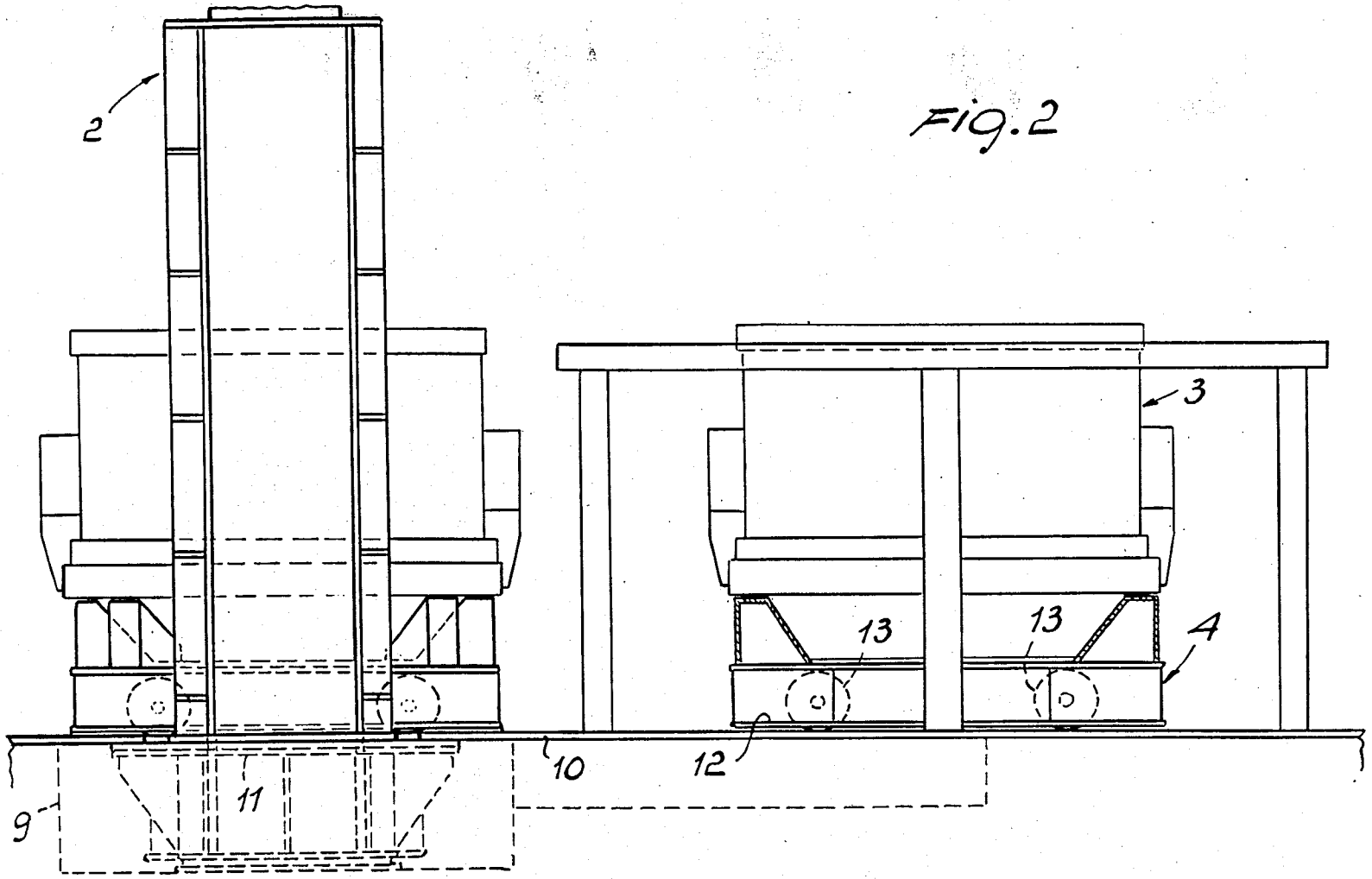
FIG. 2 is a view, taken along the direction of the arrow II of FIG. 1, with a container being moved away from the press on its carriage.

A complete apparatus for pressing and loading into smelting furnaces scrap metal, according to a first preferred embodiment of the invention, is generally designated with the reference numeral 1 in FIGS. 1 and 2. The apparatus comprises, as essential parts thereof, a compacting press 2, and a scrap metal container or loading box 3 mounted on a carriage 4, which is also a part of this invention. The press 2 is of the gate type, that is one having two side columns 5 and an overhead cross-piece 6 carrying an axially arranged hydraulic cylinder 7 driving a vertically movable press die 8. The fixed bed 9 of the press has two rails 10 along which the carriage 4 is arranged to roll, and beams 11 which provide support for the base frame 12 of the carriage during the pressing operation. The carriage features a very strong frame adapted to fully withstand the pressing force undergone by the container as the die 8 presses the loose material therein. The wheels 13 for moving the carriage project very slightly below the frame 12 such that, on account of the rail sections engaged in the pressing position moving slightly downwards, the frame 12 of the carriage is caused to bear directly on the supporting beams 11 of the press bed 9. In order to raise back the thusly lowered rail sections, and restoring the carriage to its rolling plane, hydraulic jacks 14 are provided in the bed, under the rails.

The operation of the apparatus will be now apparent. A container 3, preferably of cylindrical shape and having a tilting bottom of the scuttle or bucket type, is laid onto a carriage 4 running on rails from a loose scrap metal loading station, not shown, to the press 2. As bulk filled, the container is taken to the press, as clearly shown in FIG. 2. The jacks 14 cause the engaged sections of the rails lying below the press die 8 to be lowered, and the carriage comes to rest on the beams 11, being supported by the bed framework. The press die 8 which has cross dimensions substantially corresponding to the cross dimensions of the container 3, is then moved down to press the scrap metal in the container, which it penetrates plungerfashion. Thereafter, the die is raised back, the rails sections 10 previously lowered are now brought up again and the carriage restored to its running condition. The carriage and container thereon are taken to receive another loose load, and the whole pressing cycle is repeated until the box 3 is filled, or until a preset size is achieved for the charge. In general, more than one pressing steps will be required to strike a box full, depending on the type of scrap metal and final density to be achieved. Once filled, either completely or to the desired charge size, the carriage is taken to the furnace, location, whereat a crane will lift the box above the furnace mouth and drop the whole charge into it. A careful analysis shows that the prior drawbacks, as mentioned in the preamble, have been removed altogether in principle.

In actual practice, the apparatus described fully meets its operative expectations. Some logistic or organizational difficulties may be encountered where several furnaces having different capacities and sizes are to be served. With plural furnaces, it would be expensive to arrange one complete apparatus for each individual furnace. On the other hand, it is practically impossible to replace the die 8 of the press each time that a different box is presented to it, that is many times in a day, since if several furnaces are provided, these must be enabled to operate simultaneously. A practical solution to this complex problem of adaptation has been found with an improvement of the inventive idea which enables several furnaces to be served by a single press. The press would be modified to accommodate two different diameters of the container by fitting a detachable ring around the die, which would have suitably reduced dimensions. Advantageously, to allow one carriage to be used for different containers, it would also be constructed to fit such two different sizes.

Figure 3:
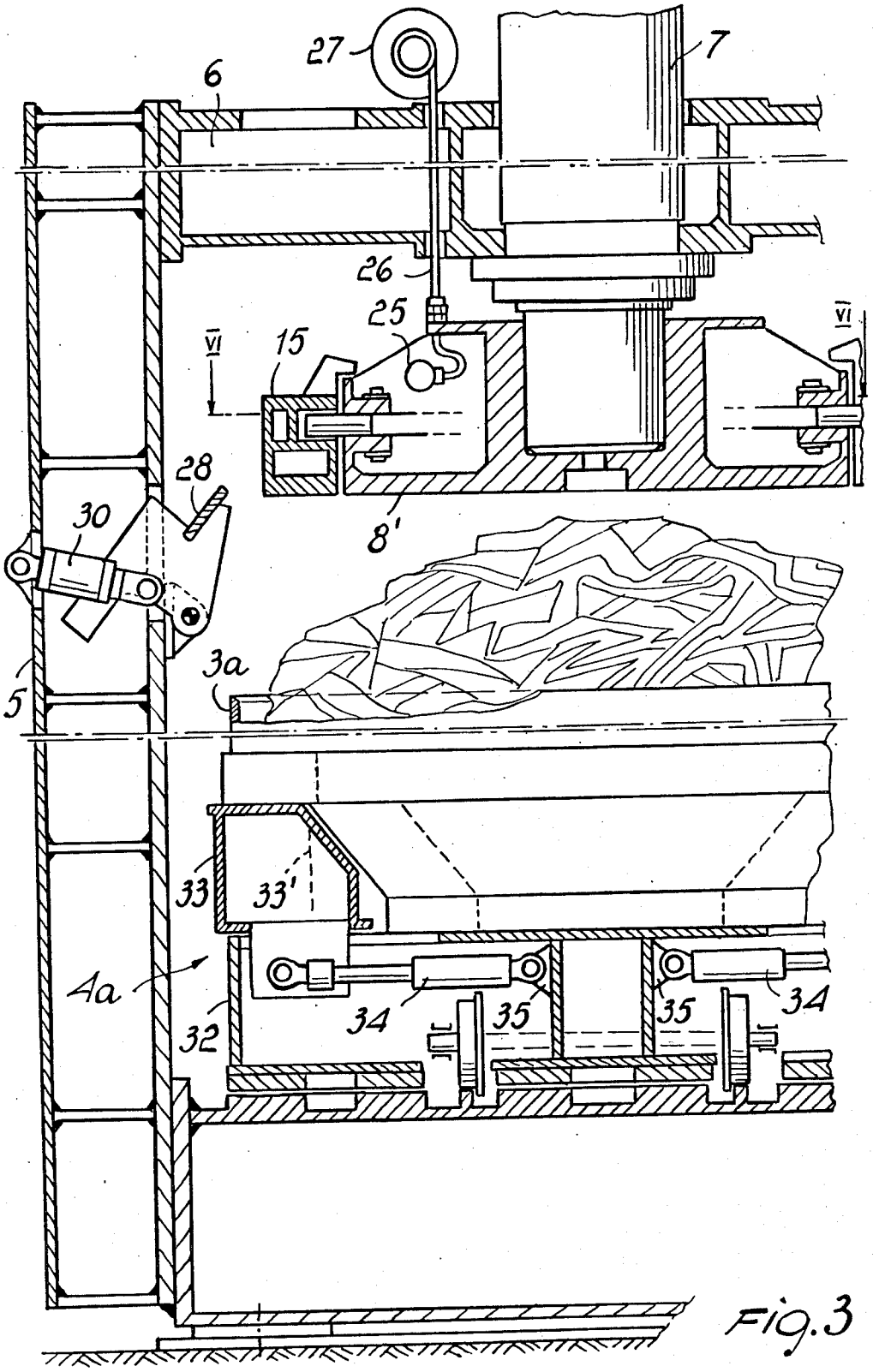
FIG. 3 is a sectional view of a variation of the embodiment shown in FIG. 1.
Figure 4:
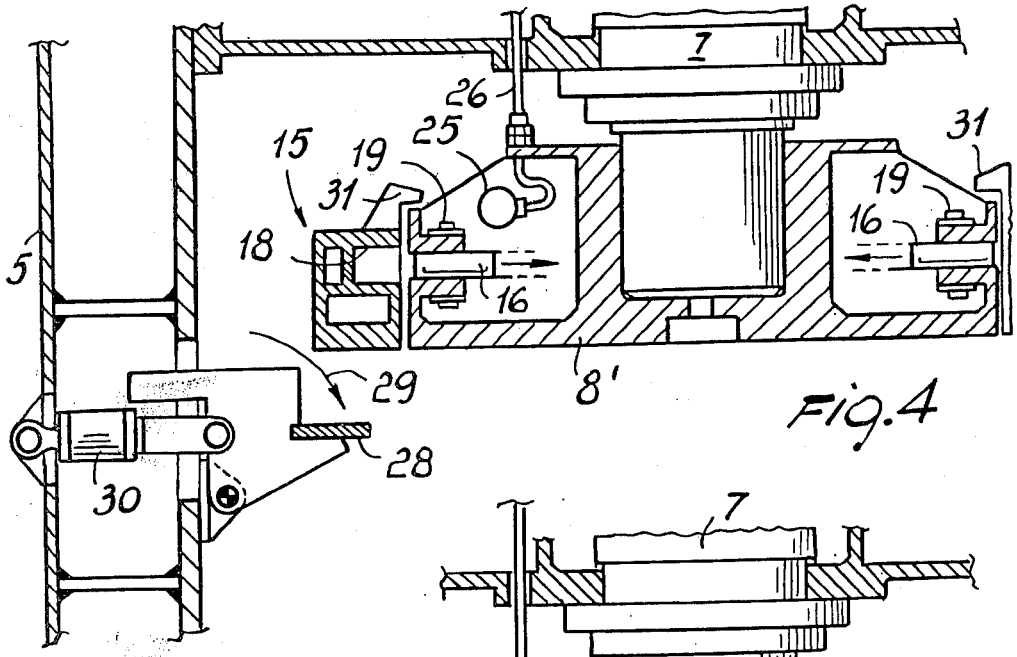
FIGS. 4 and 5 show details of FIG. 3, at different operation stages.
Figure 5:
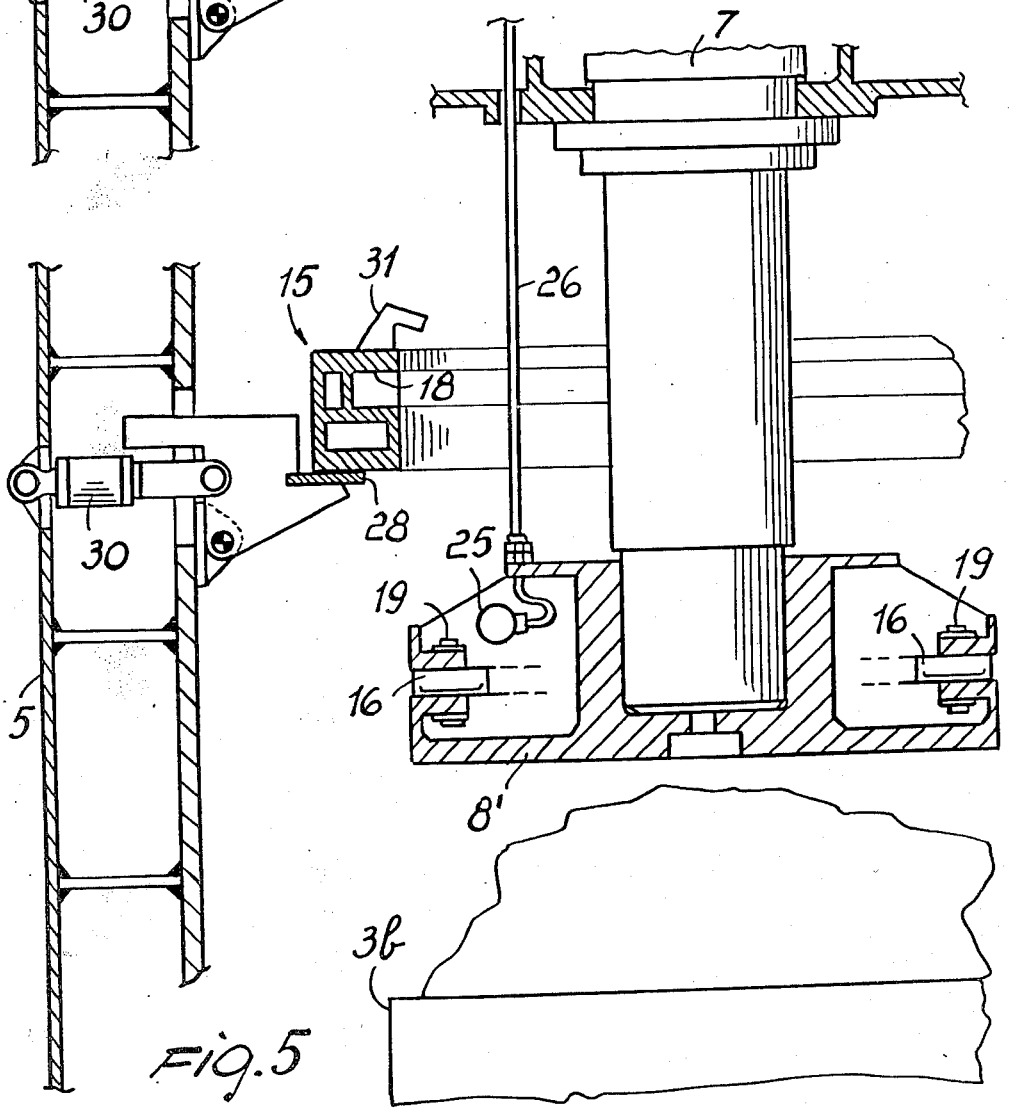
Figure 6:
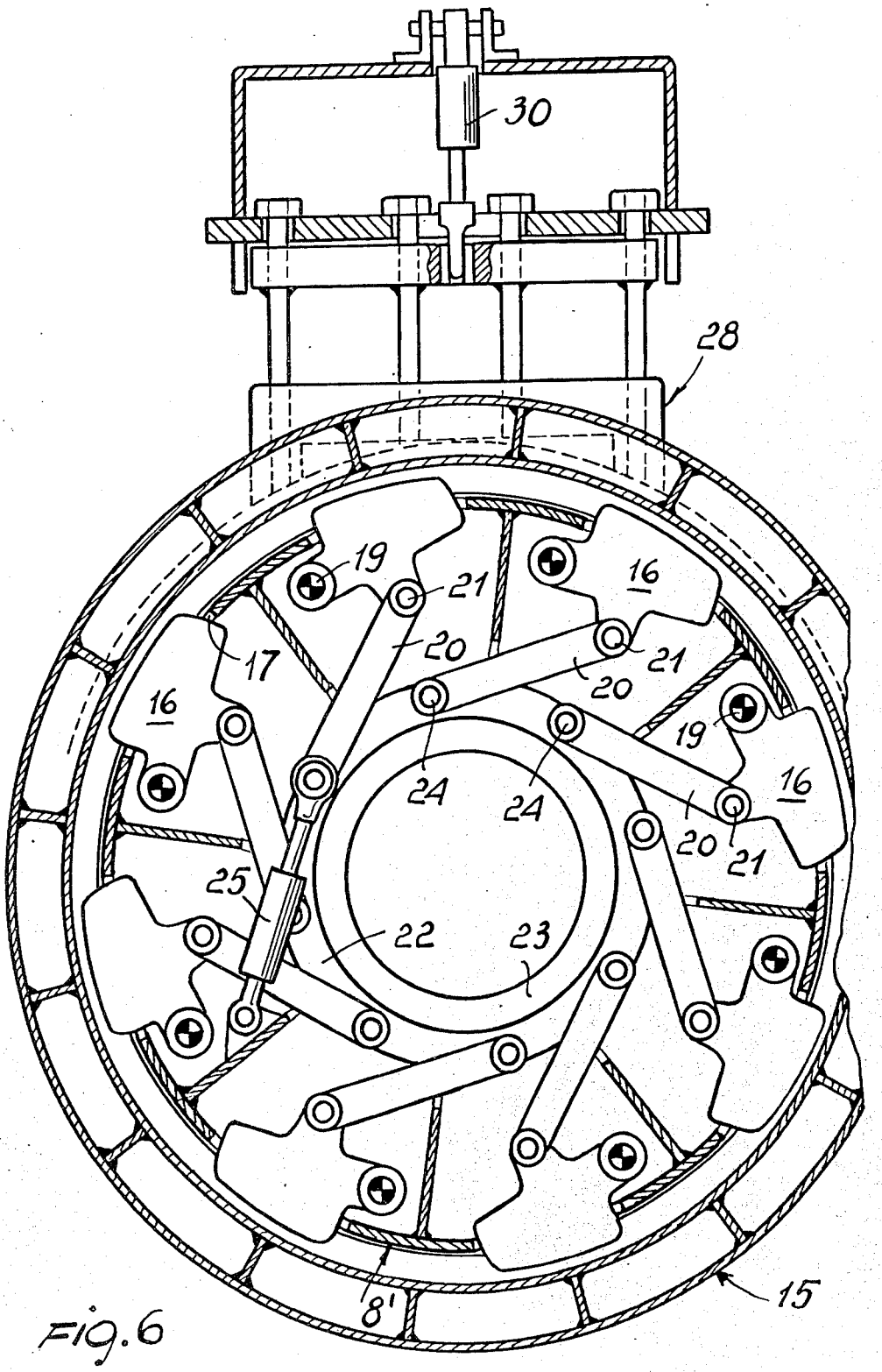
FIG. 6 is a sectional view of an isolated detail, taken along the line VI—VI of FIG. 3.

Reference is now made to FIGS. 3–6 in general. The press die 8' is provided with a ring 15 which encircles it to impart it an oversize effective diameter, and which is controllably engageable with the die. For engaging it, rabbet keys or tabs 16 are provided which can be radially moved by a lever, being located at intervals along the die 8' periphery and extendible and retractable from/into circumferential grooves 17 in the die, to engage with and disengage from engagement grooves 18 in the ring 15. The keys 15 can rock about respective die pivots 19 extending axially and are each rocked by a connecting rod 20, articulated at 21 to a key and drivingly secured to a collar 22, arranged pivotally about the hub 23, by means of respective pivot points 24. The collar 22 which synchronizes the engagement-disengagement rocking movements of the keys 16 is driven by a small hydraulic cylinder 25 fed from a hose 26 stretched from a trolley 27. When released, as shown in FIGS. 4 and 5, the die ring 15 is supported by tilting brackets 28 located at an abutment position, one on each column 5 of the press. The brackets 28 are tilted out in the direction of the arrow 29, FIG. 4, each by a hydraulic cylinder 30 pinned to a respective column 5, or are tilted in and retracted from engagement, as shown in FIG. 3, by that same drive synchronously and coordinately with the small cylinder 25 which rocks the keys 16 in and out. Thus, it may be seen that the die 8' may be driven forward to either compact a large container **3*a*, as shown in FIG. 3, or a small one 3*b*, as shown in FIG. 5**, without implying any waste of time, since the command to engage or disengage may be given during the downward stroke, without even slowing the die movement.

Advantageously, the die ring would be provided with fixed hooks 31 which suspend it to the edges of the internal die 8' as the latter moves up, irrespective of the position occupied by the keys 16 and brackets 28. This affords the possibility of prearranging the engaged and disengaged conditions during the up-reverse-down phases, during all the time that the die 8' stays above the brackets 28.

In FIG. 3, at the bottom, it is clearly shown how the carriage **4*a* has been modified to function as a rigid stand for cylindrical containers having different diameters. The carriage 4*a* still has a box-like base 32 carrying opposite abutment fixtures 33 onto which a container 3*a* or 3*b* can bear. The abutment fixtures 33 for the container are now movable toward each other and away from each other between a large base, shown in full lines, and a small base, shown in dash lines and indicated at 33'. The displacement is effected by hydraulic means 34 attached to a central supporting structure 35**.

The description above already explains how the improvement introduced to accommodate different size containers in one and the same plant operates.

The apparent savings to be achieved by serving, with two-size boxes and a single press, more than two furnaces, are not prejudicial, in the sense that it would still be advantageous to use this invention even in its simpler form of FIGS. 1 and 2, i.e. by arranging one press and complete apparatus at each actually operating furnace, or furnace type. In fact, the reduction in downtime for the furnace loading, with respect to the two prior methods, brings about and increased output and a saving in the loading operation cost, whereby amortization of the whole equipment according to FIGS. 1 and 2 may take place within a short time. Moreover, by avoiding the high pressures involved by briquette-making, the equipment can be surely made more durable.

Where different capacity furnaces exist, the ringed die press of FIG. 3 affords the faculty of feeding small furnaces with one type box, and medium and large ones with an oversize type. But this is just one possibility: another possibility, which may be more convenient with largely differring furnaces, is that of providing one press for small boxes (and furnaces) or medium-size ones, and another for large and very large boxes, it being generally easy, on the basis of the information given hereinabove, to set up computations for optimization.

While two embodiments which have appeared to be exemplary have been described hereinabove, they should not be construed as limitative of this invention, the protective scope whereof is also intended to encompass any alternatives which might occur in the light of the teachings provided.

I claim:

1. An apparatus for preparing scrap metal charges for smelting furnaces, comprising a press having a fixed press bed and a vertically movable press die, rails arranged adjacent and in said press, said rails having rail sections arranged below said press die, a carriage having wheels movable on said rails and rail sections into a position below said press die, a container for scrap metal to be compressed by said press die, said container being removably supported by said carriage and having cross dimensions substantially corresponding to the cross dimensions of said press die for allowing said press die to compact scrap metal in said container, and further comprising means for lowering said rail sections during the pressing operation, wherein said carriage has a carriage base frame and said press bed has a beam structure for supporting said carriage base frame when said rail sections have been lowered and the scrap metal is compressed by said press die.

2. An apparatus as claimed in claim 1, wherein said carriage has opposite abutment fixtures for supporting said container, and means for selectively shifting said opposite abutment fixtures in a direction toward each other and away from each other to define on said carriage support means for containers having different cross dimensions.

3. An apparatus as claimed in claim 1, further comprising a ring surrounding said press die of said press, and means for selectively engaging said ring with, and disengaging said ring from, said press die to define a press die having different cross dimensions.

4. An apparatus as claimed in claim 3, wherein said means comprise keys peripherally supported by said press die and radially movable with respect thereto, and grooves in said ring for receiving said keys.

5. An apparatus as claimed in claim 3, further comprising tiltable brackets arranged on support columns of said press, and means for tilting said brackets between a tilted out position in which they sustain said ring when the latter is disengaged from said press die and a tilted in position in which they allow vertical movement of said ring with said press die.

6. An apparatus as claimed in claim 3, wherein said ring has fixed hooks for suspending said ring on said press die.

* * * * *